US006656055B1

(12) United States Patent
Marro

(10) Patent No.: US 6,656,055 B1
(45) Date of Patent: Dec. 2, 2003

(54) MACHINE FOR LEARNING THE GOLF SWING

(76) Inventor: Antonio Foncillas Marro, Avenida de la Aurora, 27 1° A, 29002 Málaga (ES)

( * ) Notice: Subject to any disclaimer, the term of this patent is extended or adjusted under 35 U.S.C. 154(b) by 0 days.

(21) Appl. No.: 09/380,223

(22) PCT Filed: Dec. 22, 1997

(86) PCT No.: PCT/ES97/00309

§ 371 (c)(1),
(2), (4) Date: Aug. 26, 1999

(87) PCT Pub. No.: WO99/32199

PCT Pub. Date: Jul. 1, 1999

(51) Int. Cl.[7] ..... A63B 69/36
(52) U.S. Cl. ..... 473/207
(58) Field of Search ..... 473/215, 216, 473/207, 214, 227, 269, 266; 482/908, 906

(56) References Cited

U.S. PATENT DOCUMENTS 3,767,204 A 10/1973 Ray
4,593,909 A 6/1986 Anselmo
4,758,000 A * 7/1988 Cox ..... 473/215
4,895,372 A 1/1990 Muller
5,050,885 A * 9/1991 Ballard et al. ..... 473/215
5,688,212 A * 11/1997 Walker ..... 473/215

* cited by examiner

*Primary Examiner*—Mark S. Graham
*Assistant Examiner*—Raeann Gordon
(74) *Attorney, Agent, or Firm*—Robert M. Schwartz; Gerald R. Hibnick

(57) ABSTRACT

The invention is a machine for learning the bodily position and motion known as a swing in the game of golf to form correct golf posture based on a player's height, and more specifically the player's distance from the hips to the ground and from the shoulders to the hips and by the motions during the golf swing. The machine learns the bodily position and motions of the golf player in hitting the ball. The machine includes two plates arranged so that they can move on a column, one at the height of the player's hips and the other at the height of the shoulders, the latter with arms leaving said plate and ending in a hinged belt for holding the hips and the other having a lower arm and upper arm terminating in a shoulder bar for holding the player's shoulders.

10 Claims, 5 Drawing Sheets

MACHINE FOR LEARNING THE GOLF SWING

OBJECT OF THE INVENTION

The invention here proposed consists of a machine for learning the bodily position and motions which a golf player must carry out in hitting the ball, also known as the player's swing, an important stroke among those used in the game of golf.

The machine belongs to the field of training machines for diverse activities which foster a correct bodily position and the following guidance for the player's motions.

To this end the machine includes a set of exchangeable templates and articulated arms which acting together with the corresponding means of attachment to the player's hips and shoulders forces the correct motion for this stroke.

BACKGROUND OF THE INVENTION

Training machines for a wide range of activities, studies and even professions are well known to the general domain, and may be classified into simulators and true repetitive learning machines.

This type of machine foster learning particularly for movements which are not altogether natural, such as a golf swing, since the player must carry out several turns which are independent but must be co-ordinated, and are unusual and hard to remember both by the muscles or mind of the player, so that it is necessary to repeat this motion over and over in order to learn it.

Due to the popularity of the game of golf there exist a great deal of documentation, studies and analyses of how to perform the game's most characteristic and fundamental stroke, as well as the most difficult one, the swing.

In short, one must consider two main planes, the hip and the shoulder planes, and the angles for their positioning, both with respect to each other and to the ground, as well as defining their relative motions, analysed both individually and jointly and in co-ordination. One must also consider the height above the ground for each of these, which is given by the height of the player's hips and shoulders.

The applicant is not aware of any machines for teaching the golf swing, that is, to make the player, or student, adopt a correct position and perform the movements of the entire body or part of it until these are performed correctly by repetition.

DESCRIPTION OF THE INVENTION

The invention object of the present memory related to a machine for learning the bodily position and motions known as a swing in the game of golf, from among the training machines for diverse activities, which in first place is given by a correct posture, which depends on the player's height, more specifically on the distance from the hips to the ground and from the shoulders to the hips, and also by the motions which these must carry out.

Since the first thing which the machine most achieve is to position the players correctly and to hold them so that the correct motions are performed, holding structure or means of attaching or connecting are provided, specifically a type of belt to hold the hip and a sort of shoulder bar to hold the shoulders, with these attachments in turn articulated to the corresponding guide arms as will be described below.

To obtain the correct posture, knee angle and back position, means are required so that both the hip belt and the shoulder bar are placed at the correct height, so that the player can perform this either manually, by operating levers, or automatically, by entering the data in a computer.

These means consist of a solid support column which at the areas which correspond to the positions of the belt and shoulder bar is provided with respective cogged areas engaged by a worm gear driven by a motor or a crank handle.

The turning motions which the player must perform in the swing, both of the hips and the shoulders, are preset by those carried out by arms which are connected to both the belt and the shoulder bar, which originate either in a mechanical or automatic manner.

In any event the means which originate these motions are installed in corresponding metal plates both placed horizontally and connected to the column where the height regulation means mentioned above are located.

These emotions to be carried out are statistically selected from those typically performed by the top 20 players in the world, or those which a given player or teacher carries out, so that the player can always select the movement to carry out.

For the mechanical operation the plates are provided with guides and are interchangeable, so that each plate has a guide system corresponding to the pre-defined movements which are desired.

For the automatic operation the motions are stored in a memory and use is considered of several pantographs placed on several places on the arm and a flat plate with no type of guide.

In order to perform the movement which the arms must be given in the mechanical embodiment, two templates are projected, one for the arms of the belt and one for the shoulder bar arms, which are provided with orifices where wheels or casters are housed which are connected to the arms both at the top and at the bottom. These orifices, actually paths for displacement of the arms, are to be made in each support plate of the arms.

Since motion both of the hips and shoulder must be related, it is necessary to provide means which do so. The first tests used rods connecting the joints of the arms which moved in the template, both in the upper and lower one, with optimal results regarding their operation, but with the inconvenient of being heavy and strenuous to operate, as well as noisy.

Moreover, it was intended to motorise the unit, so that this motorisation was chosen as the means of co-ordinating the motion, with excellent results.

A positive drive means in the form of magnetic actuators were chosen, which consist of an electric coil with a ferromagnetic element in its core, so that as the coil is excited with passing current the core is displaced in one direction or another depending on the polarity of the electrical current, providing a solution which is easily controlled and co-ordinated by means of a suitable computer program.

These electric elements known as linear magnetic actuators are articulated by an articulated coupling to each template and their free end to the casters, so that the force used to perform the motion will be the sum of the force exerted by the player and that exerted by the magnetic actuators, which may be adjusted from 0 to a maximum force at will by the player.

The belt and shoulder arms are to be provided with a telescoping or lengthening mechanism so that the belt can swivel with respect to the horizontal axis.

Regarding its automatic operation, at each point of the arms where specific movements must be performed is placed a pantograph, of the type well known and commonly used, to which motion is applied both horizontally and vertically by means of corresponding stepping motors. These motors have been chosen due to their precision in turning, and their simple control by means of a computer where the game of as many players as desired can be stored, a memory which can in the future be increased, and easily selected.

In both possible embodiments each arm is given motion both on its free end as in its paracentral area; in the mechanical embodiment the motion is applied on the casters placed on the arm and in the automatic one on the arm itself.

Certain players may prefer at times not to practice the hip and shoulder motions simultaneously, so that machines are projected with only the hip belt and its mechanisms, or the shoulder bar and its mechanisms, but always maintaining the mechanisms and arrangements described above.

DESCRIPTION OF THE DRAWINGS

As a complement of the description being made and for a better and clearer understanding of the characteristics of the invention, attached to the present descriptive memory and as an integral part of it is a set of drawings where, for purposes of illustration and in a on-limiting manner, the following is shown.

PREFERRED EMBODIMENT OF THE INVENTION

Figure 1:
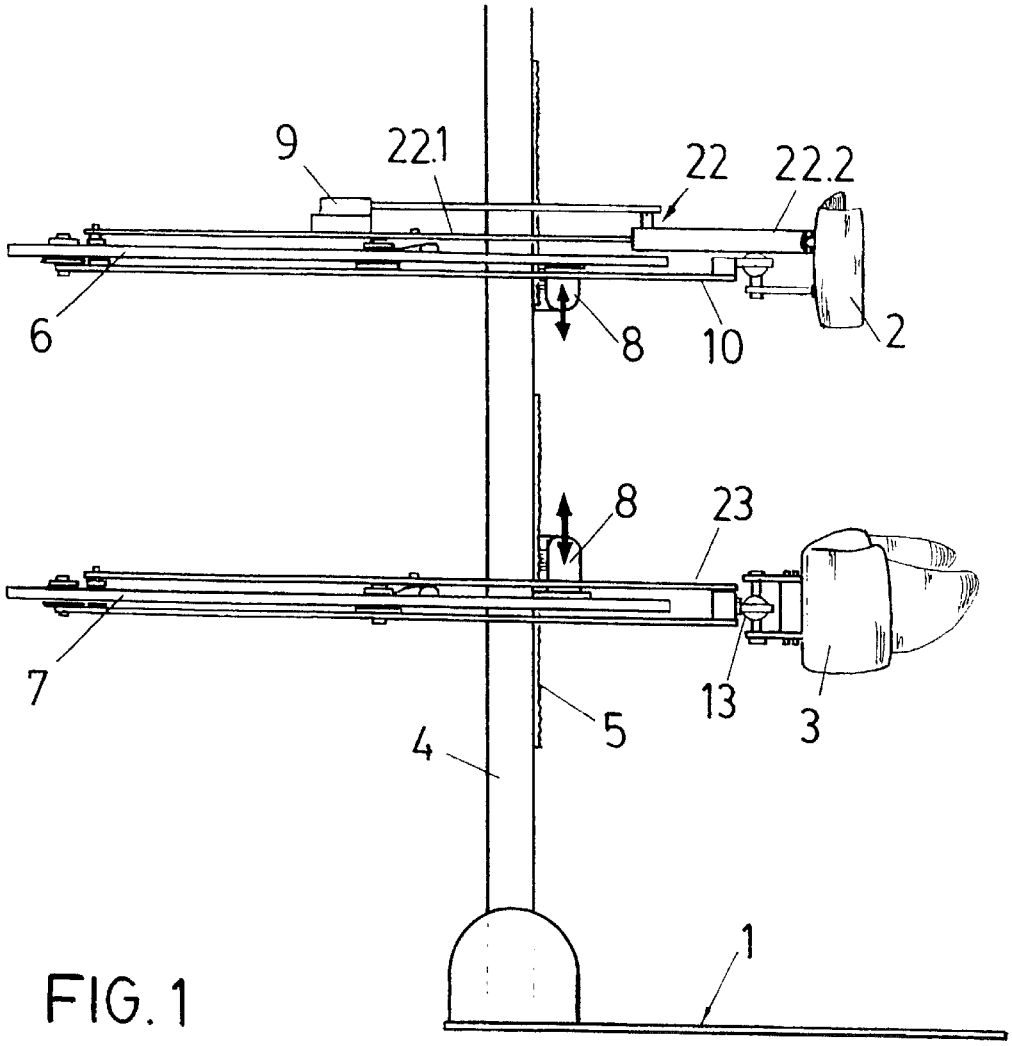
FIG. 1 shows a side elevation view of the machine of the invention as in its preferred embodiment.

In view of the above, the present invention relates to a machine for teaching and/or practicing the swing, from among training machines, which characterises the correct body position starting by the correct lacing of the hips and shoulders, and therefore of the proper bending angle for the knees and back of the player, as well as defining the turns and motions.

The machine consists of a platform (1) on which the player initially stands, and a sturdy column (4) is anchored down which supports a first plate (7) at the height of the player's hips and another plate (6) at shoulder height.

Holding structure, comprising two parts: the belt (3), which holds the hips, and shoulder bar (2) for the shoulders. These two parts (3, 2) are coupled to plates (7) and (6) respectively, incorporating respective cogged areas (5) on column (4), one for each template, connected to gears operated by respective motors (8) set on (6–7) plate so that as the motor turns the template will move up or down.

With this arrangement before assuming the position the player introduces the corresponding data on height, hip-floor and hip-shoulders in the computer placed in the machine, with belt (3) and shoulder bar (2) adopting the correct heights.

Furthermore, in order to complete the player's position the machine is provided with a positive drive means in the form of linear magnetic actuators (15, 9) which adjust the length of the arms which move belt (3) and shoulder bar (2).

Shoulder bar (2) is provided with a lower arm (10) and an upper one (22) divided into an initial segment (22.1) and an end segment (22.2) mounted telescopically, with the end segment joined to shoulder bar (2) movable by the action of an actuator (9) mounted on the initial segment (22.1).

This arrangement is common to both embodiments for the machine, both, the manual and the automatically operated ones.

Figure 2:
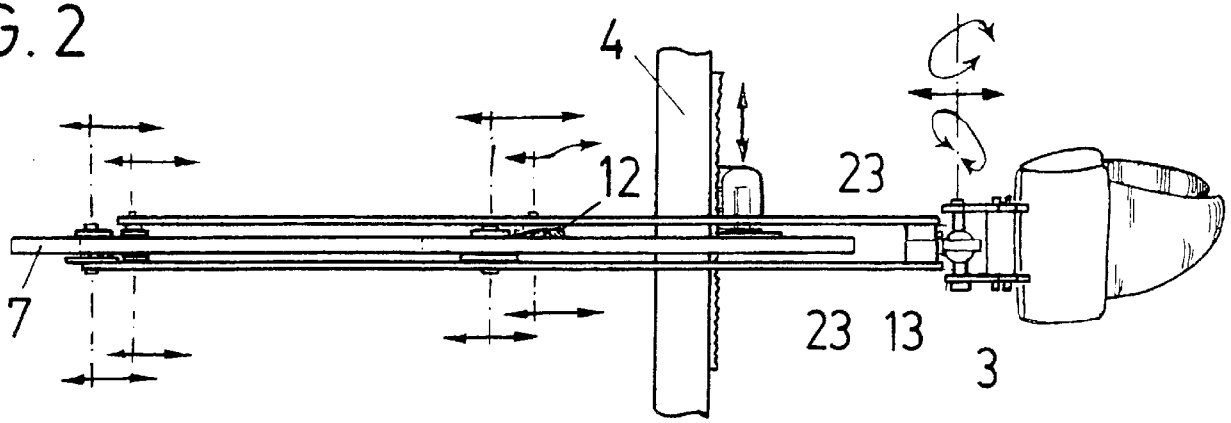
FIG. 2 shows an outline detail of one of the templates, specifically the one at hip height.
Figure 3:
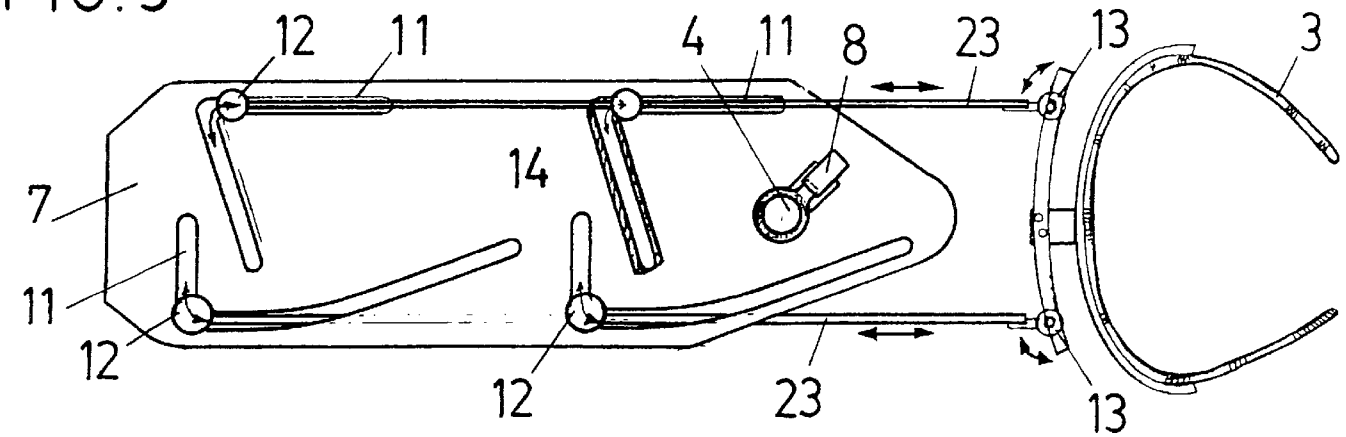
FIG. 3 shows a plan view of the above figure showing the path followed by the articulated arms.
Figure 4:
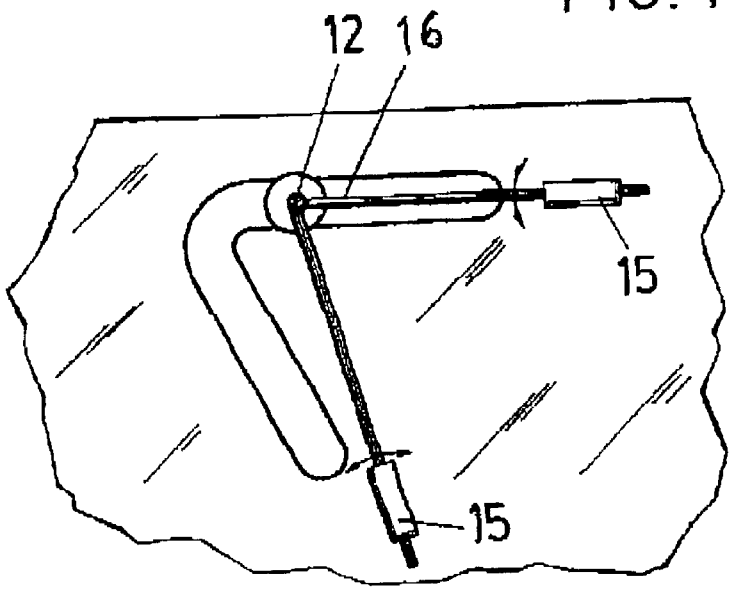
FIG. 4 shows a plan view detail of the arrangement of the linear magnetic actuators on the arm casters.
Figure 5:
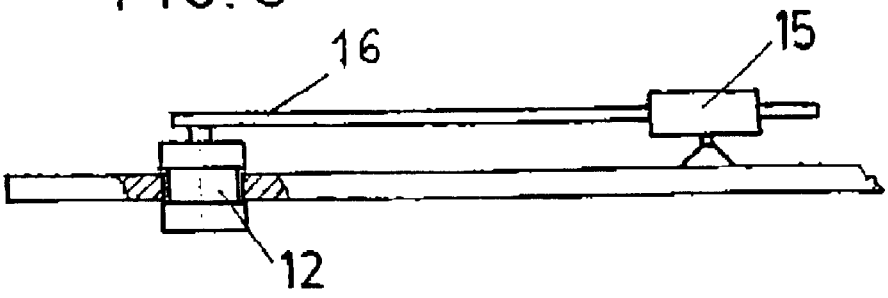
FIG. 5 shows a side view of the previous figure.
Figure 6:
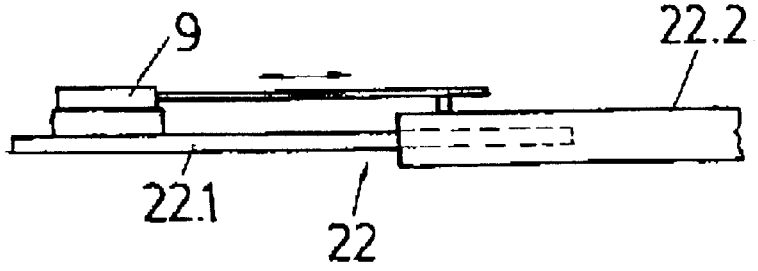
FIG. 6 shows the arrangement of the extender on one of the arms connected to the shoulder bar with a linear actuator mounted on a sector of the arm.
Figure 7:
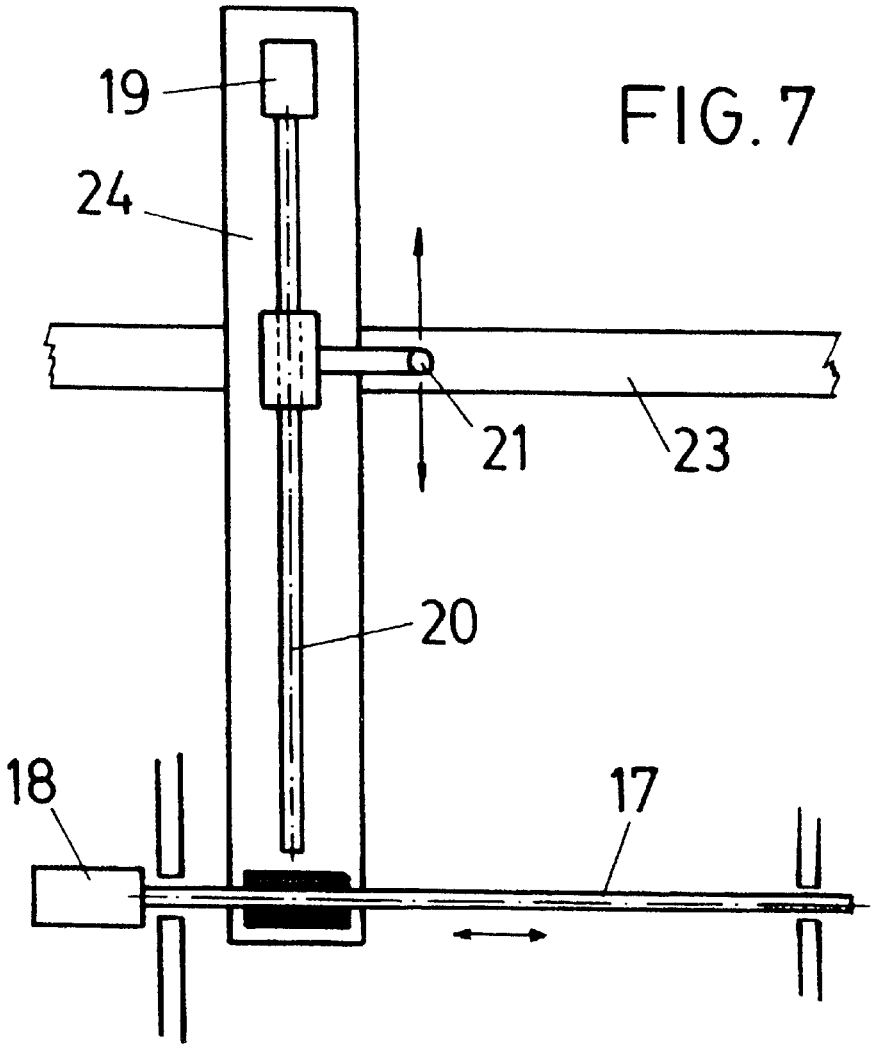
FIG. 7 shows the arrangement of the pantograph on one of the arms of the hip belt.

Regarding its embodiment for manual operation, FIGS. 2 and 3 show a set of template (7) plus arms (23) which join it to the player holding elements, here showing the hip element, but this can be extended to the template and arms which hold the shoulders.

This particular template (7) has grooves or paths (11) inside which roll wheels or casters (12), articulated both on the top and on the bottom to arms (23), and these in turn are connected by a hinge (13) to belt (3).

In any event the arrangement and shape of grooves (11) is set so that movements selected statistically among those of the top 20 players in the world, or from those performed by a specific player, or new ways which may be determined in the future, but in any case they are made interchangeable so that they always meet the player's preferences.

For the specific case of the execution of the stroke selected, a ramp (14) was required in the rising segment a-b of the corresponding caster (12).

As mentioned in the presentation of this descriptive memory, movements may be motorized, for which linear magnetic actuators (15) are provided, placed so that they can turn on the template (6–7) and with their free end (16) articulated as an articulated coupling on the corresponding caster (12), in a number and manner so that their motion guides caster (12) within guide (11).

The figures only show these actuators (15) on one of the arms, but the explanation and arrangement of these must be made extensive to all the others.

To control all of this described a computer program has been developed which is not the object of this descriptive memory, which controls and adjusts all of the above electronic devices, so that the player need only enter data on height, assistance in turning motions and the rest to make the machine execute these automatically.

Regarding its automatic operation, a pantograph (24) is placed on all points of the arms where specific movements are needed, which begins from two worm gears (17-20) placed perpendicular to each other and driven by corresponding motors (18-19) of the type known as stepping motors, with worm gear (20) placed on a base (20) engaged to worm gear (17), while worm gear (20) engages to a element which carries the shaft (21) on which the arm pivots.

This description is not extended further in the understanding that any expert in the field would have enough information to understand the scope of the invention and the advantages derived thereof, as well as to be able to reproduce it.

It is understood that as far as they do not change the essence of the invention, variations in the materials, shape, size and arrangement of the elements are subject to variation within the same characterisation.

The terms used in this description and its sense must be taken in a non-limiting manner

What is claimed is:

1. A machine for moving at least one part of a person's body through a repeatable pattern of motions for the learning of that pattern of motions, one such pattern being a golf swing; said machine having:

at least one part of a holding structure for impinging upon a part of the person;

at least one guide arm having one end coupled to said one part of said structure for imparting selectively controlled movement to said structure, such movement resulting in at least a portion of the pattern of motions for the person's body;

said arm being oriented substantially horizontally and mounted for controlled movement in a horizontal plane;

drive means coupled to at least one point on said arm;

said one end thereby driven to selected points on said plane, for selectively controlled movement of said structure and thereby the person's body part upon which it impinges; and a template having at least one part thereof coupled to said guide arm;

said template having at least one pathway defined therein;

guided means fitted in said pathway and connected to said arm; and said guided means arranged to be positively driven along said pathway by said drive means to impart movement to said arm and thereby said holding structure, which results in a body part, upon which said structure impinges, to be moved to define at least one portion of said pattern of motions.

2. A machine according to claim 1 in which, there are at least two of said arms coupled to different locations on said machine, to impart a greater range to said selectively controlled movement.

3. A machine according to claim 1 in which, there are two guide arms, each said arm having said one end coupled to a respectively different, vertically spaced apart, location of said machine.

4. A machine according to claim 1 in which, there are two said body part holding structures adjustably spaced vertically part, the improvement comprising:

at least one articulated coupling coupled to said guided means, through which said template and said guide arm are coupled to said holding structure.

5. A machine according to claim 1 further comprising:

an articulated coupling having one end connected to said guided means in said template; and a positive drive to said articulated coupling for positively driving said guided means, said guide arm and said body holding structure.

6. A machine according to claim 1 in which, said guide arm is horizontally extendable for advancing said holding structure toward impinging contact with a body part of the person.

7. A machine according to claim 1 in which, a plurality of said guided means are fitted into different locations along said pathway and are independently driven by said drive means.

8. A machine according to claim 1 in which, said drive means is motorized and connected to said guided means; and automatic means is coupled to said motorized drive means to selectively impart drive to said guided means, such drive becoming translated into at least one of said repeatable pattern of motions.

9. A machine according to claim 1 in which, said template is removable and interchangeable with at least one other template for defining a different pattern of motions.

10. A machine according to claim 1 in which, said template and said pathway lie in the same substantially horizontal plane.

* * * * *